US006290545B1

(12) United States Patent
Wang et al.

(10) Patent No.: US 6,290,545 B1
(45) Date of Patent: Sep. 18, 2001

(54) CIGARETTE LIGHTER INSERT WITH ELECTRICAL REJUVENATION CONTACT TIP

(75) Inventors: Wellington Chien-Yuan Wang, Manlius, NY (US); Domingo Fung; Stuart Leer, both of Hong Kong (CN); Joel Samuel Teller, Carmel, IN (US)

(73) Assignee: Thomson Licensing S.A. (FR)

( * ) Notice: Subject to any disclaimer, the term of this patent is extended or adjusted under 35 U.S.C. 154(b) by 0 days.

(21) Appl. No.: 09/419,388

(22) Filed: Oct. 15, 1999

(51) Int. Cl.[7] ..... H01R 17/18
(52) U.S. Cl. ..... 439/668; 439/387
(58) Field of Search ..... 439/668, 387, 439/314, 10, 25, 620, 621, 490, 489

(56) References Cited

U.S. PATENT DOCUMENTS

| | | | | |
|---|---|---|---|---|
| 4,118,690 | * | 10/1978 | Paynton | 439/314 |
| 4,305,180 | * | 12/1981 | Schwartz | 24/221 R |
| 4,560,223 | * | 12/1985 | Cooney et al. | 339/95 R |
| 5,170,067 | * | 12/1992 | Baum et al. | 439/668 |
| 5,775,952 | | 7/1998 | Lu | 439/668 |

OTHER PUBLICATIONS

Japanese Patent Abstracts, JP60038529, Appln. No. 58146950.
Japanese Patent Abstracts, JP57043127, Appln. No. 55119144.

* cited by examiner

*Primary Examiner*—Gary F. Paumen
*Assistant Examiner*—Alexander Gilman
(74) *Attorney, Agent, or Firm*—J. S. Tripoli; J. J. Laks; J. J. Kolodka

(57) ABSTRACT

An insert for a cigarette lighter socket includes a body and a contact rejuvenation tip protruding from and non-rotatable relative to the body. The contact rejuvenation tip includes abrasive elements on its surface for contacting an electrical contact in a cigarette lighter socket. In a preferred embodiment, the abrasive elements are pyramidal in shape and situated on an end surface of the contact rejuvenation tip. The abrasive elements scrape off electrically insulating material on an electrical contact in a cigarette lighter socket as the contact rejuvenation tip is rotated relative to the contact in the cigarette lighter socket. The insert includes a flexible strip attached to the body for resiliently centering a part of said body and said contact rejuvenation tip within said cigarette lighter socket.

17 Claims, 2 Drawing Sheets

CIGARETTE LIGHTER INSERT WITH ELECTRICAL REJUVENATION CONTACT TIP

FIELD OF THE INVENTION

This invention relates generally to the field of cigarette lighters in a vehicle, and more particularly, to an insert for improving conduction with a contact of a cigarette lighter socket.

BACKGROUND INFORMATION

There has been a proliferation of portable communications devices, including cellular phones and electronic computing devices such as laptop computers and hand held personal computing devices, that are powered or their battery pack recharged by a DC power supply converted from a vehicle's DC power supply, accessible from the cigarette lighter socket. Power to these devices is typically fed through an adaptor plug inserted into the cigarette lighter socket to electrically connect a conductive contact tip on the power adaptor to a contact tip in the cigarette lighter socket. Current is conducted over the connection between the contact tips of the power adaptor and socket to either an electrical device for immediate operation or to a battery pack(s) or battery pack charger. The increasing reliance on these devices for communications and computing tasks makes it imperative that the vehicle's cigarette lighter socket cooperate with the power adaptors to provide DC power for operating the devices or charging their battery packs.

A number of devices which are to be powered through the vehicle's cigarette lighter socket are returned to the manufacturer under the mistaken assumption that the devices do not operate properly because of a manufacturing defect. In many instances, the problem resides not with the device, but with poor electrical contact between the power adaptor's conducting or contact tip and the lighter socket's contact tip. The surface of the contact tip in the cigarette lighter socket is prone to oxidation or contamination by cigarette ashes deposited by a cigarette lighter plug. The oxidation or ashes deposited can act as an insulation barrier to conduction between the contact tips of the power adaptor and lighter socket. Accordingly, there is a need for a device which will improve electrical contact or conduction between the contact tips of the power adaptor and cigarette lighter socket.

SUMMARY

A cigarette lighter insert includes a body; and a tip on the body for abrasively engaging and removing electrically insulating material from a contact in a cigarette lighter socket as the body is moved relative to the contact. The tip has abrasive elements adapted for engaging, abrading and cleaning the contact during movement of the insert in the socket.

In a preferred embodiment, the abrasive elements are pyramidal in shape and situated on an end surface of the contact rejuvenation tip. The abrasive elements scrape off electrically insulating material on an electrical contact in a cigarette lighter socket as the contact rejuvenation tip is rotated relative to the contact in the cigarette lighter socket. The insert includes a flexible strip attached to the body for resiliently centering a part of the body and the contact rejuvenation tip within the cigarette lighter socket.

In a further embodiment, the insert includes a power adaptor assembly for electrically coupling the contact rejuvenation tip to a device connected to the power adaptor assembly. The power adaptor assembly includes a DC to DC converter for converting a voltage level at the cigarette lighter socket to a voltage level suitable for the device. The power adaptor assembly further includes over-current protection coupled between the contact rejuvenation tip and the DC to DC converter. The power adaptor assembly may include an indicator lamp for indicating an electrical contact between the contact rejuvenation tip and a contact of the cigarette lighter socket.

DETAILED DESCRIPTION OF THE DRAWINGS

Figure 1:
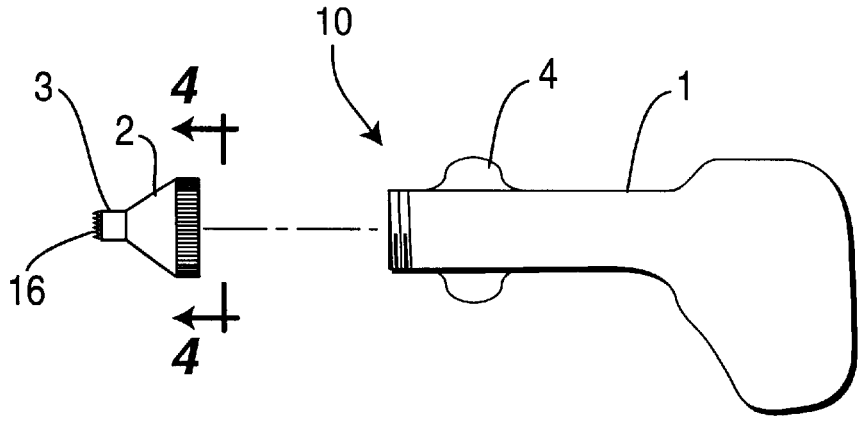
FIG. 1 is a partially exploded front elevation of a cigarette lighter insert in accordance with inventive arrangements and having a contact.

A cigarette lighter insert 10 with an inventive contact rejuvenation tip 3 is shown in FIG. 1. The contact rejuvenation tip 3 is disposed in and protrudes out from a front cover 2 that is an integral part of a body 1 or a separate feature that attaches to the body 1. The end surface of the contact rejuvenation tip 3 is provided with abrasive elements 16 so as to abrade and thereby clean an opposing surface it contacts as the end surface is rotated against the opposing surface. The abrasive elements can be integrally formed by an irregular or contoured surface. The abrasive elements can also be formed separately and attached to the tip. The flex strips 4 are resilient elements which serve to adapt the insert 10 to cigarette lighter sockets with varying diameters and retain the insert 10 tightly in a cigarette lighter socket 12 (see FIG. 5). The body 1 is shown with an irregular hand grip end portion, remote from the contact tip 3. The irregular hand grip portion improves manual holding and rotation of the body 1 when the contact rejuvenation tip 3 is positioned against an opposing contact. Alternatively, the hand grip portion can be any configuration suitable for hand gripping.

Figure 2:
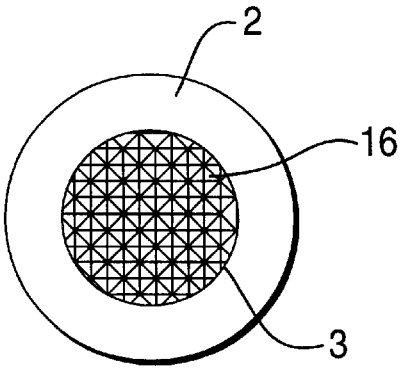
FIG. 2 is a left side elevation of FIG. 1, showing detail of an end surface of the contact rejuvenation tip.
Figure 3:
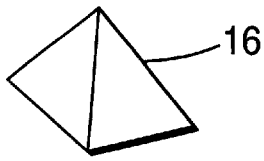
FIG. 3 is a perspective view of an abrasive element shown in FIG. 2.

FIG. 2 is an end view of the front cover 2 with the contact rejuvenation tip 3 shown. The end surface of the contact rejuvenation tip 3 includes multiple abrasion elements 16. In the preferred embodiment, according to FIG. 3, the abrasion elements are of a pyramidal configuration culminating in a point. The sloping surfaces of the pyramidal shape shown advantageously provide space between abrasion elements to temporarily accept material loosened from a socket contact tip 13 (see FIG. 5), as the contact rejuvenation tip 2 is pressed and rotated against the socket contact tip 13. The abrasion elements can also be, for example and without limitation, linear, partially spherical, star, square, or cylindrical. The alternative abrasion element shapes are also spaced apart from each other to provide a temporary repository for material loosened from the socket contact tip 13.

Figure 4:
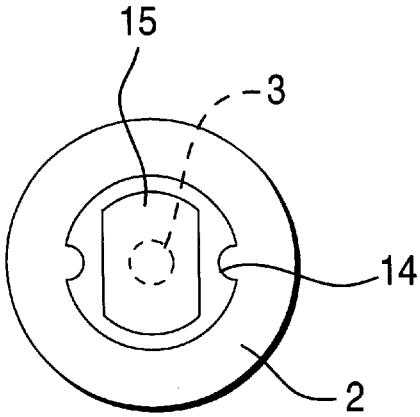
FIG. 4 is a side elevation taken along line 4—4 in FIG. 1.

FIG. 4 depicts an end view of the inside of the front cover 2, illustrating how rotation of the contact rejuvenation tip 3 relative to the front cover 2 is prevented. The contact rejuvenation tip 3 has a flange 15 with edges that are prevented from full rotation relative to the front cover 2 by interference indentations 14 extending inwardly from the inside of the front cover 2. The flange 15 edges which can engage with the indentations 14 are shown to be linear, but can be any configuration in which rotation of the contact rejuvenation tip 3 relative to the front cover 3 is prevented. Such alternative interference fit structures include threaded and keyed structures.

Figure 5:
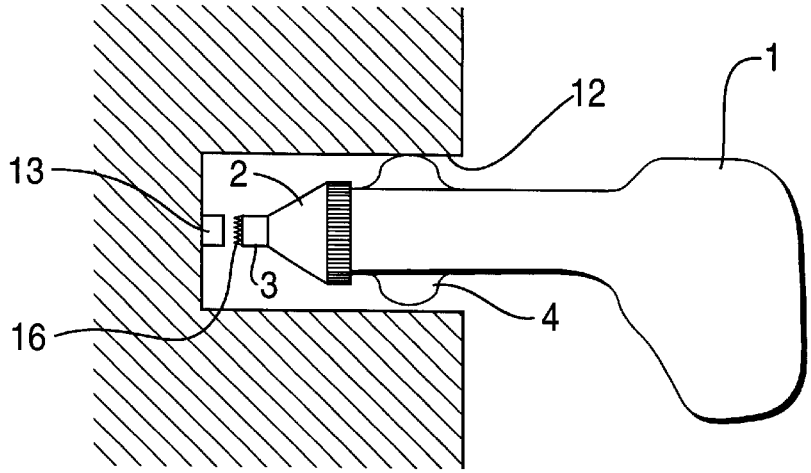
FIG. 5 shows the cigarette lighter insert of FIG. 1 inserted into a vehicle cigarette lighter socket.

In FIG. 5 the cigarette lighter insert 10 is shown positioned inside a vehicle's cigarette lighter socket 12. The flex strips 4 center and tightly retain the insert 10 in the socket 12. The end surface with abrasion elements 16 of the contact rejuvenation tip 3 is positioned against the cigarette lighter socket's contact tip 13. FIG. 5 exaggerates the distance between the contact rejuvenation tip 3 and the socket's contact tip 13 to illustrate the interaction between the tips 3, 13. In practice the insert 10 is rotated to rotate the abrasive elements 16 of the contact rejuvenation tip 3 against the contact of the socket 13 and abrade away any surface material on the socket contact 13 that is corroded or otherwise acts as an electrical insulator. Once the insulating material is abraded away the insert 10 can be removed and a power adaptor for a device can be inserted into the cigarette lighter's socket to make electrical contact with the socket's contact tip 13 and provide power to the device.

Figure 6:
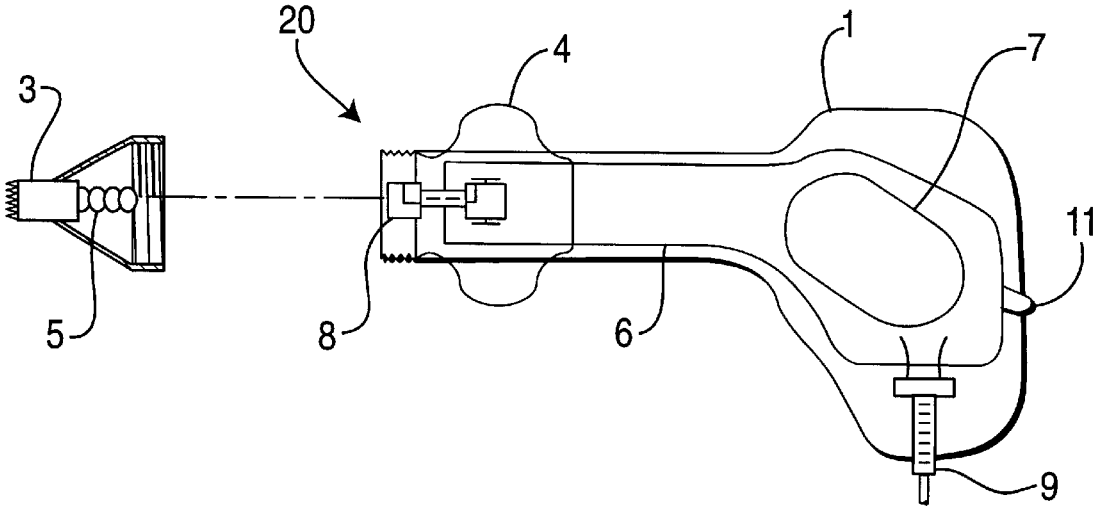
FIG. 6 is a cut away view of an alternative insert in which a power adaptor is provided with the inventive contact rejuvenation tip.

FIG. 6 depicts an alternative insert 20 employing the inventive contact rejuvenation tip 3 and configured as a power adaptor plug. The inventive contact rejuvenation tip 3 improves electrical contact with the contact tip 13 of the cigarette lighter socket 12. The exemplary power adaptor plug 20 includes a body case 1 that is assembled. The body case member 1 shown mates with a complementary body case member, not shown, to form a body case assembly which houses the elements shown in FIG. 6. The body case assembly engages with the front cover 2 by a conventional fit technique including but not limited to threaded, snap, keyed, or friction fit. Within the front cover 2, shown partially cut-away, are the contact rejuvenation tip 3 protruding through an aperture in the front cover 2 and a spring 5. Preferably, the spring is fixed to an end of the contact rejuvenation tip 3 and serves to bias the contact rejuvenation tip 3 out the aperture of the front cover 2, when the front cover 2 is engaged with the body case 1.

Within and protruding out the body case 1 are the flex strips 4. At least one of the flex strips is electrically conductive and together with the contact rejuvenation tip 3 forms a complete electrical connection with the vehicle's cigarette lighter socket 12. The flex strips 4 are resilient or flexible to accommodate diameter variations in cigarette lighter sockets, while maintaining contact pressure between the end surface abrasion elements 16 of the contact rejuvenation tip 3 and an opposing socket contact tip 13, when the power adaptor 20 is plugged into the cigarette lighter socket 12. The at least one flex strip 4 is mounted on and electrically connected to a circuit board 6 within the body case 1. The circuit board 6 includes a conventional power conversion circuit 7 for converting a voltage, available at the cigarette lighter socket, to a form suitable for a device connected to the power adaptor 20, when the power adaptor 20 is plugged into the lighter socket 12. For example, the vehicle power supply of 13 volts DC can be down-converted by the power conversion circuit 7 to 4.5 volts at a maximum of 600 milliamps (mA). Alternatively, the conventional power conversion circuitry 7 can provide DC to AC power conversion. In a further alternative embodiment of the power adaptor 20, the power conversion circuit may be eliminated where the power adaptor serves a device which can operate or be recharged by the vehicle's existing voltage, e.g., 12–14 volts DC.

Preferably, an over-current protection device such as the fuse 8 is friction fitted and electrically connected at one end to the circuit board 6 by fuse tabs 15. The other end of the fuse 8 contacts a spring 5 attached to the end of the contact rejuvenation tip when the front cover 2 is engaged to the body case assembly. An optional indicator lamp 11 can be employed to illuminate when an electrical contact is made between the contact rejuvenation tip 3 and the socket contact tip 13. Alternatively, the indicator lamp can be employed to indicate when a device draws current through the power adaptor 20 plugged into the lighter socket 12.

A conductor cable 9, shown wired to the circuit board 6, has a strain relief portion fitted to the body case member 1 to prevent breaking the conductor connections to the circuit board 6. Alternatively, the conductor cable is separate from the power adaptor 20, but connected to the circuit board 6 through a mating female or male plug connector wired to the circuit board 6.

Inserting the power adaptor 20 into a cigarette lighter socket 12 is the same as that described for the embodiment of FIG. 1. The conducting strip 4 is resiliently biased against a wall of the lighter socket 12 to provide resistance against the power adaptor 10 coming out of the lighter socket 12 and to form part of the electrical connection path through the cigarette lighter socket 12. The contact rejuvenation tip 3 is resiliently biased against the socket contact tip 13 by the spring 5, shown in FIG. 1. Should the indicator lamp fail to illuminate because of a poor electrical contact between the plug and socket contact tips 3, 13 the power adaptor is rotated, whereby rotating the abrasion elements 16 of the contact rejuvenation tip 3 and abrading away any surface material on the socket contact tip 13 that is corroded and acts as an electrical insulator. This rotation is continued until the indicator lamp 11 illuminates to indicate a sufficient electrical contact between the contact rejuvenation tip 3 and the socket contact tip 13.

Variations, combinations and permutations of the above as would occur to those of ordinary skill in the art are included in the scope and spirit of the invention.

We claim:

1. A cigarette lighter insert for extracting electrical energy from a cigarette lighter socket, said insert comprising:

a body; and a metal tip on said body for electrically connecting the cigarette lighter socket and abrasively engaging and removing electrically insulating material from a contact in the cigarette lighter socket as said body is moved relative to said contact, said tip having a planar surface substantially perpendicular to its longitudinal axis, said surface includes abrasive elements which are distributed throughout said planar surface in any preferred pattern, said abrasive elements being adapted for engaging, abraiding and cleaning said contact during movement of said insert in said socket, said elements being formed of any preferred shape and being spaced apart from each other to provide a temporary repository for material loosened from said contact.

2. An insert according to claim 1, wherein said abrasive elements are of a pyramidal configuration and are situated on an end surface of said tip.

3. An insert according to claim 1, further comprising a flexible strip attached to said body for resiliently centering a part of said body and said tip within said cigarette lighter socket.

4. An insert according to claim 1, wherein said body comprises structure interfering with rotation of said tip relative to said body.

5. An insert according to claim 4, wherein said structure comprises indentations that interfere with rotation of a flange of said contact rejuvenation tip.

6. An insert according to claim 1, further comprising a power adaptor assembly for electrically coupling said tip to an electrical device.

7. An insert according to claim 6, wherein said power adaptor assembly comprises a DC to DC converter.

8. An insert according to claim 5, wherein said power adaptor assembly comprises an indicator lamp for indicating an electrical contact between said contact rejuvenation tip and a contact of said cigarette lighter socket.

9. An insert according to claim 1, wherein said abrasive elements are of a configuration selected from the group consisting of linear, partially spherical, star, square, ellipse, rectangular, and cylindrical.

10. An insert according to claim 1, further comprising a flexible strip attached to said body for resiliently centering a part of said body and said means within said cigarette lighter socket.

11. An insert according to claim 1, further comprising a power adaptor assembly for electrically coupling said means to a device.

12. An insert extracting electrical energy from for a power receptacle having at least two electrical contacts, said insert comprising:

a handle;

a plug extending from said handle;

an abrasive tip on said plug adapted electrically contact said receptacle and to abrasively engage and clean one of said at least two electrical contacts of said receptacle as said plug is moved in said receptable by said handle, said tip having a planar surface for extracting electrical energy from a cigarette lighter socket, said insert abrasive elements which are distributed throughout said planar surface in any preferred pattern, said abrasive elements being adapted for engaging, abraiding and cleaning said contact during movement of said insert in said receptacle, said elements being formed of any preferred shape and being spaced apart from each other to provide a temporary repository for material loosened from said contact.

13. The insert of claim 12, further comprising at least one flexible member extending from said plug and adapted to engage an inner surface of said receptacle to center said plug therein.

14. The insert of claim 13, wherein said receptacle and said plug are substantially cylindrical, said tip extending axially from said plug, said at least one flexible member extending radially from said plug, and said abrasive and cleaning engagement occurring during rotation of said plug in said receptacle.

15. The insert of claim 12, wherein said receptacle and said plug are substantially cylindrical, said tip extending axially from said plug and said abrasive and cleaning engagement occurring during rotation of said plug in said receptacle.

16. The insert of claim 13, further comprising a power converter disposed in said handle, said tip and said at least one flexible member being electrically conductive for respective engagement with said at least two electrical contacts of said socket for energizing said power converter.

17. The insert of claim 16, wherein said receptacle and said plug are substantially cylindrical, said tip extending axially from said plug, said at least one flexible member extending radially from said plug, and said abrasive and cleaning engagement occurring during rotation of said plug in said receptacle.

* * * * *